United States Patent [19]

Fields

[11] Patent Number: 4,871,273

[45] Date of Patent: Oct. 3, 1989

[54] ADJUSTABLE PAPER HANDLER APPARATUS

[75] Inventor: Robert A. Fields, Phoenix, Ariz.

[73] Assignee: Multiple Marketing Systems, Inc., Phoenix, Ariz.

[21] Appl. No.: 733,371

[22] Filed: May 13, 1985

[51] Int. Cl.[4] ..... B41J 11/46

[52] U.S. Cl. ..... 400/613.2; 226/199; 312/350

[58] Field of Search ..... 400/613.2, 605–606; 270/52; 493/410, 412; 211/175, 208; 312/294, 308, 349–350; 226/199

[56] References Cited

U.S. PATENT DOCUMENTS

| | | | |
|---|---|---|---|
| 2,275,475 | 3/1942 | Sherman | 493/410 |
| 3,013,646 | 12/1961 | Sargent | 400/613.2 |
| 3,134,474 | 5/1964 | Marchman | 400/613.2 |
| 3,767,024 | 10/1973 | Banwarth | 400/613.2 |
| 4,059,256 | 11/1977 | Palmer | 270/52 |
| 4,488,829 | 12/1984 | Hidaka | 400/605 |
| 4,515,490 | 5/1985 | Marker, III | 400/613.2 |
| 4,530,689 | 7/1985 | Ringer | 493/410 |
| 4,541,749 | 9/1985 | McCoy | 400/613.2 |

FOREIGN PATENT DOCUMENTS

| | | | |
|---|---|---|---|
| 1045571 | 1/1979 | Canada | 400/613.2 |
| 28394 | 2/1983 | Japan | 400/613.2 |

OTHER PUBLICATIONS

"Computer Printer Paper Stand" IBM Tech. Disclosure Bulletin, vol. 26, No. 11, Apr. 1984, p. 6020.

*Primary Examiner*—Eugene H. Eickholt
*Attorney, Agent, or Firm*—Harry M. Weiss

[57] ABSTRACT

An adjustable paper handler for mounting or installing on a printer accompanying a desktop personal computer, telecopier, telex or the like is disclosed. A u-shaped rigid member having removable substantially flat sides angularly and integrally seated on at least a pair of back supports, which may also be removable from the u-shape member, is used to form the upper portion of the adjustable paper handler. The removable upwardly protruding flat sides of the u-shaped member removably and adjustably accommodates a flat tray having a lip to support a folded and stacked sheet of paper after emerging from the printer. The removable flat bottom side member of the u-shaped member has at least a pair of enclosures configured underneath to form the back supports to accommodate at least two extending removable prongs of a stand bearing upon the adjustable paper handler. The enclosures have a plurality of ribs, ridges, apertures or the like configured therein to adjustably accommodate the vertically protruding members of the stand.

17 Claims, 1 Drawing Sheet

ADJUSTABLE PAPER HANDLER APPARATUS

BACKGROUND OF THE INVENTION

This invention relates generally to an apparatus and a method for handling paper originating from devices having long printing runs, such as personal computer printers, telecopier, telex printers, or the like. More particularly, the invention relates to an adjustable paper handler for receiving a contiguous sheet of printing paper, directing said paper, and thereafter permitting said paper to be neatly stacked away from the plurality of electrical cables and wires inherently attached to said printers.

At present, many computers, especially personal desktop computers, lack a means for taking into account the long contiguous sheets of paper entering into and emerging from the accompanying printers. Because of the ill-considered manner in which said paper is taken cared of, problems often occur wherein said paper, upon entering into and emerging from the printers, often crumple, when not properly guided. Moreover, the paper exiting from the printer, without proper guidance, often creates as undesirable condition of accumulating behind the printers with the accompanying computers or like machines near a plurality of electrical cables and wires inherently connected to said machines.

Accordingly, there is a substantial need for a paper handler which can be easily mounted on a printer to guide a long contiguous sheet of paper entering a printer from a paper storage compartment integral to said paper handler and to similarly guide said paper when exiting the printer to eliminate possible Jammine. Such a paper handler should be configured to properly feed the sheet of paper into the printer. Moreover, the paper handler should be made of lightweight materials so that it may be easily and conveniently mounted or installed on a printer, when necessary. Similarly, it is highly desirable for the paper handler to provide an adjustable tray means in order for a substantial amount of the exiting sheet to be neatly stacked thereon and thereby guided away from the equipment wires and cables. The paper handler must further be compact, not only to conserve space, but in order to integrally function with the operations of the printer, as well.

SUMMARY OF THE INVENTION

It is an object of this invention to provide an adjustable paper handler to integrally function with a printer which accompany a desktop personal computer, telecopier, telex or the like.

It is still another object of this invention to provide an adjustable paper handler which may be easily mounted or installed on the printer to properly guide a long contiguous sheet of paper entering said printer.

It is still another object of this invention to provide an adjustable paper handler capable of integrally accommodating a compartment for foldably storing a contiguous sheet of paper ready to be fed into said printer.

It is yet another object of this invention to provide an adjustable paper handler capable of guiding a contiguous sheet of paper entering and exiting said printer.

It is a further object of this invention to provide an adjustable paper handler capable of providing a means for allowing the exiting sheet of paper to be numerously folded and neatly stacked thereon.

It is a further object of this invention to provide an adjustable paper handler having at least a pair of integrally attached back supports to achieve a desired angle in which the paper handler may be seated to properly retain the paper thereto.

It is a further object of this invention to provide an adjustable paper handler having a stand removably and adjustably connected to the paper handler to properly mount or install said paper handler to the printer.

It is a further object of this invention to accomplish the above by an adjustable paper handler which will be light in weight, sufficiently rigid when in use, durable in construction, inexpensive and easy to manufacture.

In accordance with one embodiment of this invention, an adjustable paper handler for mounting or installing on a printer accompanying a desktop personal computer, telecopier, telex, or the like is disclosed. In this embodiment, a u-shaped rigid member having substantially flat sides angularly and integrally seated on at least a pair of back supports is used to form the upper portion of the paper handler. Each upwardly protruding flat sides of the u-shaped member has a heightened slotted portion partially along each of said protruding side to adjustably and removably accommodate a flat tray inserted thereto for mounting parallel to the generally flat bottom member of the u-shaped member. Each slotted portion has a plurality of cavities to accommodate at least one ball-type protrusion integrally connected to the sides of the flat tray which communicates to the slotted portions to permit smooth insertion, or removal of the flat tray thereto or therefrom, respectively. Each of the bottom sides of the u-shaped member and the flat tray has a lip upwardly protruding preferably parallel along the upwardly protruding flat sides.

Moreover, the flat bottom side member of the u-shaped member has at least a pair of enclosures configured underneath said bottom side member to form the back supports to accommodate at last two extending prongs of at least two vertically protruding members integrally and preferably perpendicularly connected to a horizontal base of a stand bearing upon the adjustable paper handler. The enclosures have a plurality of ribs, ridges, apertures, or the like configured therein to adjustably accommodate the vertically protruding members of the stand.

Moreover, various parts of the paper handler comprising the bottom and protruding side members of the u-shaped member, as well as the back supports, may be detachable from each other in order to be compactly stored when not in use. The parts of the stand having protruding members, further comprising horizontal and support plates may be detachable from each other, as well as from the paper handler, to permit compact storage when not in use.

The foregoing and other objects, features and advantages of this invention will be apparent from the following, more particular, description of the preferred embodiments of this invention, as illustrated in the accompanying drawings.

BRIEF EMBODIMENT OF THE DRAWINGS

Figure 5:
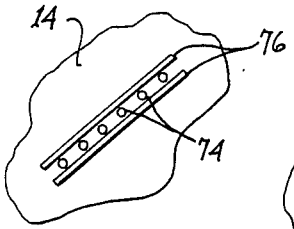
FIG. 5 is a cross-sectional view of one heightened slotted portion partially along each protruding side of the paper handler taken in the direction of arrows 5—5 shown in FIG. 3 to adjustably and removably accommodate a flat tray.
Figure 3:
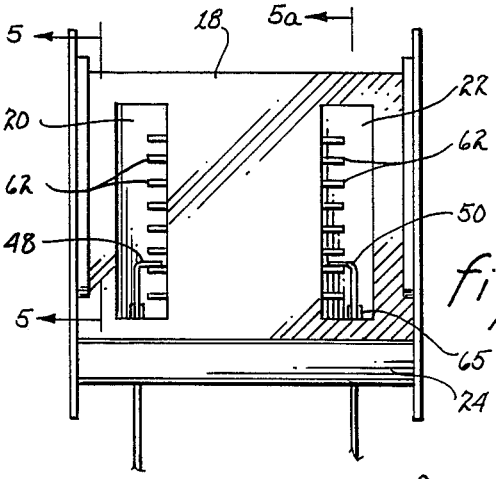
FIG. 3 is a front elevational view of the upper portion of the adjustable paper handler having a stand, the flat tray not being shown, illustrating at least a pair of enclosures configured to form the back supports underneath the bottom side members and having a plurality of ribs or ridges configured therein to accommodate vertically protruding members of the stand.
Figure 5A:
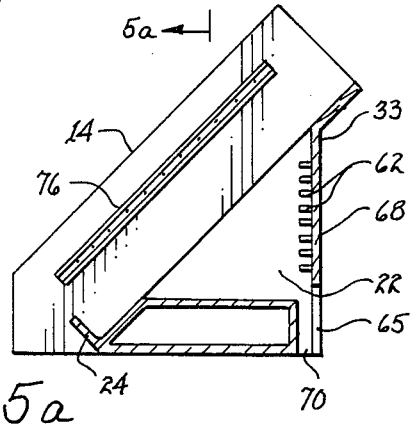

FIG. 5*a* is a cross-sectional view of one of the back supports of the paper handler taken in the direction of arrows 5*a*—5*a* shown in FIG. 3 illustrating its internal enclosure which accommodates the associated plurality of ribs or ridges configured therein.

Figure 6:
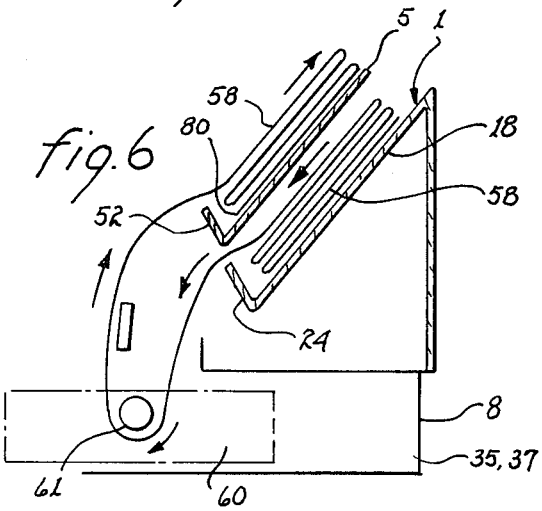

FIG. 6 is a side diagrammatic representation of the manner in which the sheet of paper communicates with the paper handler when entered into or exited from the printer.

DESCRIPTION OF THE PREFERRED EMBODIMENT

Figure 1:
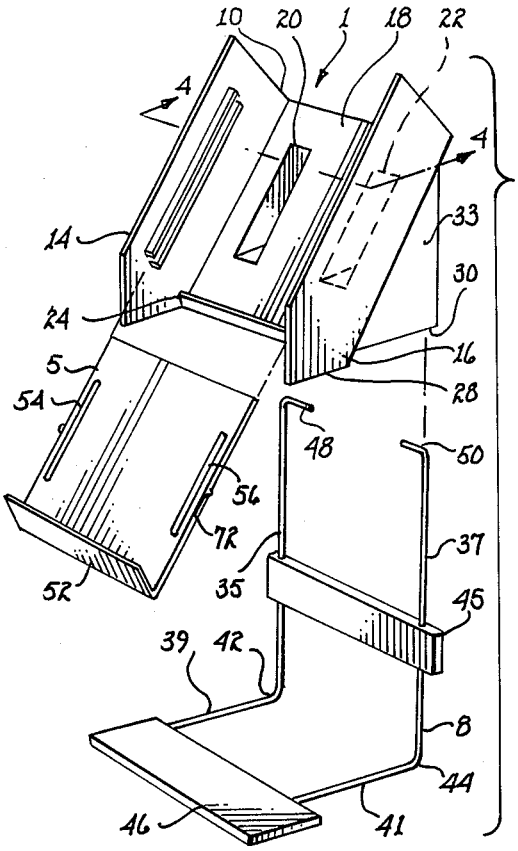
FIG. 1 is a perspective exploded view of one embodiment of an adjustable paper handler with an associated adjustable and removable tray and stand.

FIG. 1 is a perspective exploded view of an adjustable paper handler, generally designated by reference number 1, with an associated adjustable and removable tray 5 and stand 8. The paper handler 1 has a generally u-shaped member 10 having upwardly protruding flat sides 14, 16 and a generally flat bottom member 18. The bottom side member 18 has at least two integral enclosures 20, 22, the structural features of which shall be later discussed. The bottom end of the bottom side member 18 has a lip 24 integrally connected at an angle and further integrally connected on its sides by the inner surfaces of the sides 14, 16 to further provide support therein. The substantially flat upper surface of the bottom side member 18 is angled, as illustrated in FIG. 1, relative to a substantially horizontal seating surface 26 of the stand 8. In order to properly seat the paper handler 1 when the stand 8 is alternatively not in use, the bottom ends 28 of the flat sides 14, 16 as well as the bottom ends 30 of the integrally communicating back supports 33 are substantially horizontal.

The stand 8 has at least two vertically protruding members 35, 37 perpendicularly extending from at least two horizontally extending members 39, 41. The integrally connecting joints 42, 44 and support plate 45 provide structural rigidity and stability to the horizontally extending members 39, 41 and vertically protruding members 35, 37, respectively. In order to assume further stability on the stand 8, horizontal plate 46 is integrally joined at the ends of the horizontally extending members 39, 41. Moreover, the ends 48, 50 of the vertically protruding members 35, 37, protrude inwardly and perpendicularly from the vertically protruding members 35, 37, as shown in FIG. 1. Alternatively, the ends 48, 50 protrude backwardly and perpendicularly from the vertically protruding members 35, 37.

As further shown in FIG. 1, the flat tray 5 has a lip 52 angularly extending from the lower end of the flat tray 5. Moreover, at least one elongated aperture 54, 56 proximately located at each edge of the flat tray 5 and passing therethrough to provide a flexible means for removably and adjustably fitting the flat tray 5 into the protruding flat sides 14, 16 of the paper handler 1.

Figure 2:
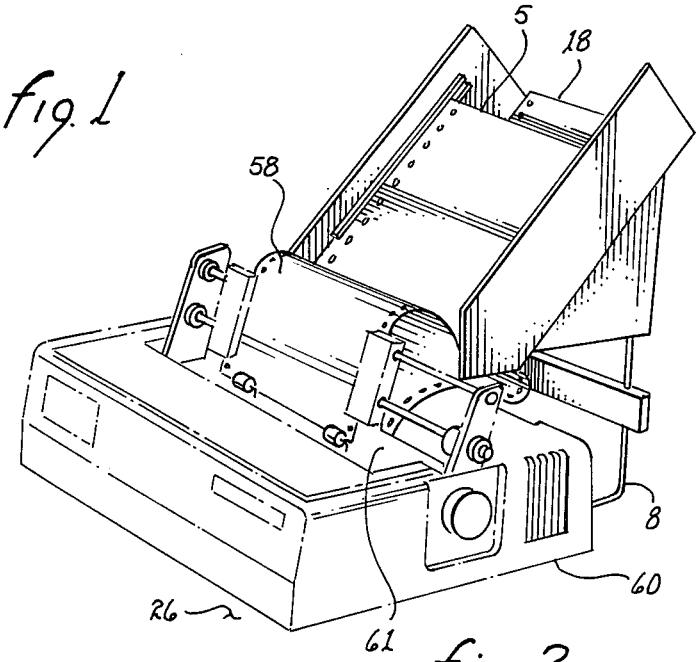
FIG. 2 is a perspective view of the adjustable paper handler accommodating a sheet of paper entering into and emerging from an associated printer ready for use.

Upon assembly of the paper handler 1, with the associated flat tray 5 and the stand 8, the adjustable paper handler of the present invention is ready for use to accommodate a sheet of paper 58 entering and emerging from and associated printer 60, as illustrated in FIG. 2. Here, the paper 58 is folded, stacked and accommodated within an enclosure (not shown) formed between the bottom side member 18 and the flat tray 5 and further supported by the lip 24 integrally connected to the bottom side member, as previously discussed. The paper 58 enters into and emerges from a roller 61 operably connected within the printer 60 and thereafter rests on the flat tray 5 while being folded, appropriately on widthwise perforations conventionally available on this type of paper, and supported by the lip 52 integrally connected to the flat tray 5, as previously discussed.

In FIG. 3, the front elevational view of the adjustable paper handler 1 is shown to illustrate the communication between the ends 48, 50 of the stand 8 and the plurality of ribs or ridges 62 configured within the enclosures 20, 22 forming the back supports 33 behind the bottom side member 18 of the paper handler 1.

Figure 4:
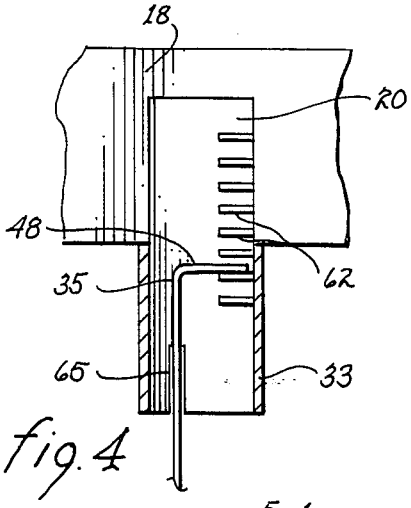
FIG. 4 is a cross-sectional view of one enclosure of the bottom side member of the paper handler taken in the direction of arrows 4—4 shown in FIG. 1 to better illustrate adjustable accommodation of one of the vertically protruding members of the stand into the plurality of ribs or ridges.

Moreover, FIG. 4 better illustrates one of the enclosures 20 of the bottom side member 18 for accommodating one of the vertically protruding members 35 of the stand 8 onto one of the plurality of ribs or ridges 62. Here, one of the ends 48 which protrude from member 35 rests on the upper surface of one of the plurality of ribs or ridges 62.

An alternatively preferred embodiment of this invention provides a plurality of apertures (not shown) on the back supports 33 passing therethrough, instead of the plurality of the above-mentioned ribs or ridges 62. Moreover, the alternative preferred embodiment provides the ends 48, 50 of the stand 8 to protrude backwardly and perpendicularly from the vertically protruding members 35, 37.

In either of the above-mentioned preferred embodiments of this invention, the back support 33, as shown in FIG. 4, has an elongated aperture 65 partially along the back portion 68 of the back support 33, as further shown in FIG. 5*a*. The elongated aperture 65 permits the vertically protruding members 35, 37 of the stand 8 to be properly inserted into an opening 70 (see FIG. 5*a*) at the bottom portion of the back support 33 and passing through the enclosures 20, 22 to permit the ends 48, 50 (of either the above-mentioned preferred embodiments) to be accommodated by the desired ribs or ridges 62 or apertures (not shown) of the back supports 33.

In order to removably and adjustably fit the flat tray 5 into the upwardly protruding flat sides 14, 16 of the paper handler 1, the flat tray, as earlier mentioned, has at least one elongated aperture 54, 56 proximately located at each edge of the flat tray 5 and passing therethrough to provide a flexible means. Moreover, each edge of the flat tray 5 has at least one dimple 72, shown in FIG. 1, to be securely accommodated by at least one of the apertures 74 of each protruding flat side 14, 16 and guided therethrough by at least a pair of guide members 76 integrally connected to each protruding flat side 14, 16, as shown in FIG. 5.

In FIG. 6, a side diagrammatic representation is shown of the manner in which the sheet of paper 58 communicates with the paper handler 1 when entered into or exited from the printer 60. The paper 58, preferably of a long contiguous type sheet having conventional perforations along its width and spaced apart along its length, is initially folded and rested on the bottom side member 18 and supported thereto by the angularly attached lip 24. An end piece 80 of the paper 58 passes through a space between lip 24 and lip 52 of the flat tray 5. The end piece 80 is fed into the roller 61 of the printer 60 and permitted therein to roll clockwise to enter into and exited from the printer 60, as illustrated in FIG. 6. The end piece 80, upon emerging from the roller 61 is allowed to roll out so that upon emergence of sufficient paper, the end piece 80 is rested on the flat tray 5 and thereafter, the paper 58 is permitted to fold and stack angularly along the flat tray 5 and supported by the lip 52. The path taken by the paper 58 from its folded position on the bottom member 18 through the printer 60 to its stacked position on the flat tray 5 is illustrated by the arrows shown in FIG. 6. Also, the height of the assembled paper handler 1 can be adjusted by accommodating the vertical protruding members 35, 37 of the stand 8 at different ribs, ridges 62 or apertures, as earlier discussed. Moreover, the flat tray 5 can be upwardly or downwardly adjusted to be properly accommodated by the printer 60 when in use.

Moreover, various parts of the paper handler 1 comprising the bottom 18 and protruding side members 14, 16 of the u-shaped member 10, as well as the back supports 33, may be detachable from each other in order to be compactly stored when not in use. The parts of the stand 8 having protruding members 35, 37, further comprising horizontal 46 and support 45 plates may be detachable from each other, as well as from the paper handler 1, to permit compact storage when not in use.

While the invention has been particularly shown and described in reference to preferred embodiments thereof, it will be understood by those skilled in the art that changes in form and details may be made therein without departing from the spirit and scope of the invention.

I claim:

1. An apparatus for handling paper entering into and emerging from a printer, comprising:

a printing means integral to said printer for operably accommodating paper;

a paper handler means suitable for communication with said printing means;

a storage means integral to said paper handler means for accommodating said paper prior to entry into said printing means;

a guide means integrally incorporated into said paper handler means for guiding said paper operably accommodated by said printing means;

a tray means removably and adjustably mounted onto said paper handler means for accommodating said paper upon emergence from said printing means;

a stand means removably connected to said paper handler means for adjustably seating said paper handler means in order to suitably function with said printing means; and a support means integrally joined to said paper handler means for removably and adjustably accommodating said stand means, said paper handler means comprises a generally U-shaped member, said u-shaped member has at least two upwardly extending members removably originating from a bottom side member, said u-shaped member comprises a lip means integrally connected to the lower portion of said u-shaped for supporting said paper upon entering into said printing means.

2. The apparatus for handling paper of claim 1, wherein said guide means comprises at least a pair of elongated members integrally joined partially along each of said upwardly extending members of said u-shaped member, said elongated members adjustably communicating with said tray means.

3. The apparatus for handling paper of claim 2, wherein said tray means comprises at least one flexible member means proximate to each edge of said tray means for adjustably fitting said tray means into said guide means.

4. The apparatus for handling paper of claim 3, wherein said flexible member means has at least one elongated aperture partially passing therethrough proximate to each edge of said tray means.

5. The apparatus for handling paper of claim 4, wherein said tray means comprises a lip means integrally connected to the lower portion of said tray means for supporting said paper upon emergence from said printing means.

6. The apparatus for handling paper of claim 5, wherein said stand means comprises at least a pair of vertically extending members removably attached to the base.

7. The apparatus for handling paper of claim 6, wherein each of said vertically extending member of said stand has at least one generally inwardly protruding end member generally perpendicular from each of said vertically extending member.

8. The apparatus for handling paper of claim 6, wherein each of said vertically extending member of said stand has at least one generally backwardly protruding end member generally perpendicular from each said vertically extending member.

9. The apparatus for handling paper of claim 8, wherein said support means comprises at least one chamber means adjacent to said bottom side member of said u-shaped member for adjustably accommodating said vertically extending members of said stand means, said support means may be removably attached to said paper handler means.

10. The apparatus for handling paper of claim 9, wherein said chamber comprises a plurality of ridges integrally joined to the back portion of each of said chamber to adjustably accommodate said inwardly protruding end members of said stand means.

11. The apparatus for handling paper of claim 9, wherein said chamber comprises a plurality of apertures on the back portion of each of said chamber passing therethrough to adjustably accommodate said backwardly protruding end members of said stand means.

12. An apparatus for handling a contiguously long sheet of paper suitable for entering into and emerging from a printer, comprising:

a printing means integral to said printer for operably accommodating said paper;

a u-shaped member having at least two upwardly extending members removably originating from a bottom side member suitable for communicating with said printing means, said u-shaped member has a lip integrally connected to the lower portion of said bottom side member for supporting said paper upon entering into said printing means;

a storage chamber integral to said u-shaped member for accommodating said paper prior to entry into said printing means;

at least a pair of generally parallel elongated members integrally joined partially along each of said upwardly extending member of said u-shaped member, each of said upwardly extending member has a plurality of indentations therebetween said elongated members;

a generally flat tray having at least one elongated aperture partially passing therethrough proximate to each edge of said tray for adjustably fitting said tray into said elongated members of said upwardly extending member of said u-shaped member;

a stand having at least a pair of vertically extending members removably attached to a base; and at least a pair of support members engaging with said bottom side member of said u-shaped member.

13. The apparatus for handling a contiguously long sheet of paper of claim 12, wherein said flat tray has a lip integrally connected to the lower portion of said tray for supporting said paper upon emergence from said printing means and at least one dimple protruding from each edge of said tray to permit said tray to be adjustably, yet sturdily accommodated into said elongated members of said upwardly extending members of said u-shaped member having indentations therebetween.

14. The apparatus for handling a contiguously long sheet of paper of claim 12 wherein each of said removable vertically extending member has at least one generally inwardly protruding end member generally perpendicular from each of said vertically extending member.

15. The apparatus for handling a contiguously long sheet of paper of claim 14 wherein said support members are suitable for accommodating a plurality of ridges therein for adjustably communicating with said end members of said stand, said support members may be removably attached to said u-shaped member.

16. The apparatus for handling a contiguously long sheet of paper of claim 12 wherein each of said vertically extending member has at least one generally backwardly protruding end member generally perpendicular from each of said vertically extending member.

17. The apparatus for handling a contiguously long sheet of paper of claim 16 wherein said support members are suitable for accommodating a plurality of apertures passing therethrough the back portion of said support members for adjustably communicating with said end members of said stand.

* * * * *